US006672895B2

(12) United States Patent
Scheiner

(10) Patent No.: US 6,672,895 B2
(45) Date of Patent: Jan. 6, 2004

(54) MARKING SYSTEM FOR LEAD CONNECTOR AND HEADER

(75) Inventor: Avram Scheiner, Vadnais Heights, MN (US)

(73) Assignee: Cardiac Pacemakers, Inc., St. Paul, MN (US)

( * ) Notice: Subject to any disclaimer, the term of this patent is extended or adjusted under 35 U.S.C. 154(b) by 0 days.

(21) Appl. No.: 09/994,467

(22) Filed: Nov. 26, 2001

(65) Prior Publication Data

US 2003/0100220 A1 May 29, 2003

(51) Int. Cl.[7] ..... H01R 3/00
(52) U.S. Cl. ..... 439/491; 439/907
(58) Field of Search ..... 439/491, 488, 439/909; 174/112; 607/36

(56) References Cited

U.S. PATENT DOCUMENTS

| | | | | | |
|---|---|---|---|---|---|
| 3,510,822 | A | * | 5/1970 | Patterson | 439/488 |
| 4,781,619 | A | * | 11/1988 | Ikeda | 439/491 |
| 4,820,193 | A | * | 4/1989 | Noorily | 439/491 |
| 4,860,750 | A | | 8/1989 | Frey et al. | 128/419 P |
| 4,998,343 | A | * | 3/1991 | Costello | 439/491 |
| 5,486,202 | A | | 1/1996 | Bradshaw | 607/37 |
| 5,545,188 | A | | 8/1996 | Bradshaw et al. | 607/37 |
| 5,626,626 | A | | 5/1997 | Carson | 607/36 |
| 5,645,577 | A | | 7/1997 | Froberg et al. | 607/37 |
| 5,683,433 | A | | 11/1997 | Carson | 607/36 |
| 5,775,935 | A | * | 7/1998 | Barna | 439/491 |
| 5,851,226 | A | | 12/1998 | Skubitz et al. | 607/126 |
| 6,112,121 | A | | 8/2000 | Paul et al. | 607/37 |
| 6,192,276 | B1 | | 2/2001 | Strandberg | 607/37 |

* cited by examiner

*Primary Examiner*—Renee Luebke
*Assistant Examiner*—Felix O. Figueroa
(74) *Attorney, Agent, or Firm*—Schwegman, Lundberg, Woessner & Kluth, P.A.

(57) ABSTRACT

A marking system to enable physicians to determine whether a connector of a lead is properly seated within the pulse generator.

19 Claims, 5 Drawing Sheets

MARKING SYSTEM FOR LEAD CONNECTOR AND HEADER

TECHNICAL FIELD

This application relates to a marking system for proper connection of a connector with an energy source such as an implantable electrical stimulator.

BACKGROUND

Connector assemblies are used to couple a conductor with a device. For instance, a connector is used to couple a cardiac stimulator system such as a pacemaker, an anti-tachycardia device, a cardioverter or a defibrillator with a lead having an electrode for making contact with a portion of the heart.

There are many different lead connectors and headers in use today. For example, there is VS1/IS1 short pin, 3.2 mm long pin, 3.2 mm low profile long pin, 3.2 mm short pin, 5 mm long pin, etc. Furthermore, there are many different types of terminal connections in headers used in pulse generators. For example, there is IS-1, VS-1, VS-1B, VS-1A, 5/6 Header, etc.

For each combination of lead connector and header, the lead connector is advanced into the header a different distance for proper seating. It is often difficult to differentiate between a lead that is seated correctly and one that is not advanced far enough. When inserted into the pacemaker, the components of the terminal connection undergo axial stress as the physician forces the proximal end of the lead into the pacemaker. This can result in damage to the lead or connector if the physician tries to push the connector further into the header than designed.

After insertion of the connector within the pulse generator, the physician may pull on the lead to ensure the terminal end is sufficiently seated in the pacemaker, placing additional axial stress on the terminal connection. Alternatively, if the connector is not seated far enough within the header, an improper electrical connection will likely occur. An improper electrical connection is typically not detected until the pulse generator is placed in a pocket of tissue within a patient and testing of the lead has begun. If the lead must be reseated within the header, additional time and potentially additional trauma to the patient is incurred. Additional time is wasted due to uncertainty of the connection, as the physician moves the pulse generator around or squints at the device to determine whether the connector has been properly seated within the pulse generator. As newer systems increase the number of leads and connectors, the amount of time wasted during insertion of the lead increases.

Accordingly, what is needed is a system which allows a physician to establish quickly and with certainty whether a lead has been properly seated within an energy source.

SUMMARY

A marking system to enable physicians to quickly and decisively determine whether a connector is properly seated within the pulse generator.

An assembly is provided including a header with an energy source. The assembly further includes at least one first connector extending from a terminal end to a distal end, and the terminal end is disposed within a first opening of the header. The header includes at least one header marking thereon, and the terminal end of the connector has at least one connector marking thereon, where the connector marking matches the header marking. The at least one connector marking provides a visual indication of proper placement of the connector within the header.

Several options for the assembly are as follows. For instance, in one option, the header marking is disposed around the first opening of the header, and the header marking is disposed on an external surface of the header. The connector marking, in one option, is disposed completely within the header when the connector is properly seated therein. In another option, the header marking includes a first header marking of a first color, a second header marking of a second color, and the first color is different than the second color. In yet another option, the connector marking includes a first connector marking of a first color, a second connector marking of a second color, and the first color is different than the second color, and optionally the first and second connectors include a third color marking that, when properly inserted, line up with one another. The assembly, in another option, includes a first connector having a first color marking and a second connector having a second color marking, and the header marking includes the first color marking and the second color marking thereon. In yet another option, the header is translucent, and optionally a color is embedded adjacent to the at least one opening.

In yet another embodiment, a system includes a pulse generator having an energy source, and a connector coupled with a lead. The lead has a lead body and at least one electrode, and the connector is coupled with the pulse generator. The system further includes a means for visually indicating when the connector is properly seated within the pulse generator, where the means for visually indicating is applied to the connector and an external surface of the pulse generator.

Several options for the assembly are as follows. For example, in one option, the pulse generator includes a color marking thereon, the color marking disposed directly adjacent to an opening of the pulse generator. In another option, the color marking is disposed around a perimeter of the opening of the pulse generator, and the opening receives the connector therein.

In another embodiment, the system includes a lead and a lead body, and a connector coupled with the lead. The system further includes a pulse generator with an opening, and the opening is sized and configured to receive the connector therein. The system further includes a first visual indicator marked around the opening of the pulse generator, and a connector marking disposed on the terminal end of the connector. The connector marking is substantially similar as the first visual indicator.

Several options for the system are as follows. For instance, in one option, the first visual indicator has a first color, the connector marking has a second color, and the first color matches the second color. In another option, the visual indicator has a first pattern, the connector marking has a second pattern, and the first pattern matches the second pattern. In yet another option, the pulse generator includes a second opening therein. The second opening has a second visual indicator marked around the second opening, where the second visual indicator is different than the first visual indicator. The system optionally further includes a second lead with a second connector, and the second connector includes a second connector marking thereon. The second connector marking is substantially similar to the second visual indicator.

In another embodiment, a method includes marking a connector with at least a first connector visual indicator, marking an external surface of a header with a first header visual indicator, where the first header visual indicator matches the first connector visual indicator. The method further includes inserting the connector into the header, and stopping insertion of the connector into the header once the first connector visual indicator is no longer visible.

Several options for the method are as follows. For instance, in one option, marking the connector comprises marking the connector with a color marking. In another option, marking the header comprises marking the header with a color marking. In yet another option, marking the header comprises marking around an opening of the header, and inserting the connector includes inserting the connector into the opening. The method, in another option, further includes marking a second lead with a second connector visual indicator, disposing the second lead into the second opening, and stopping insertion of the second lead into the second opening when the second connector visual indicator is no longer visible. In another option, marking the header comprises marking around a first opening with the first header visual indicator, and marking around a second opening with a second header visual indicator.

The marking system allows for a physician to easily identify whether or when a lead has been properly seated within a header. Furthermore, the system provides for an effective and inexpensive marking system. The system further assists in preventing unnecessary stress exerted on the lead, for example, by a physician checking whether a lead has been properly placed within the header. Still further, the system allows proper identification of leads relative to their appropriate openings within the header.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims and their equivalents.

DESCRIPTION OF THE EMBODIMENTS

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the scope of the present invention. Therefore, the following detailed description is not to be taken in a limiting sense, and the scope of the present invention is defined by the appended claims and their equivalents.

Figure 1:
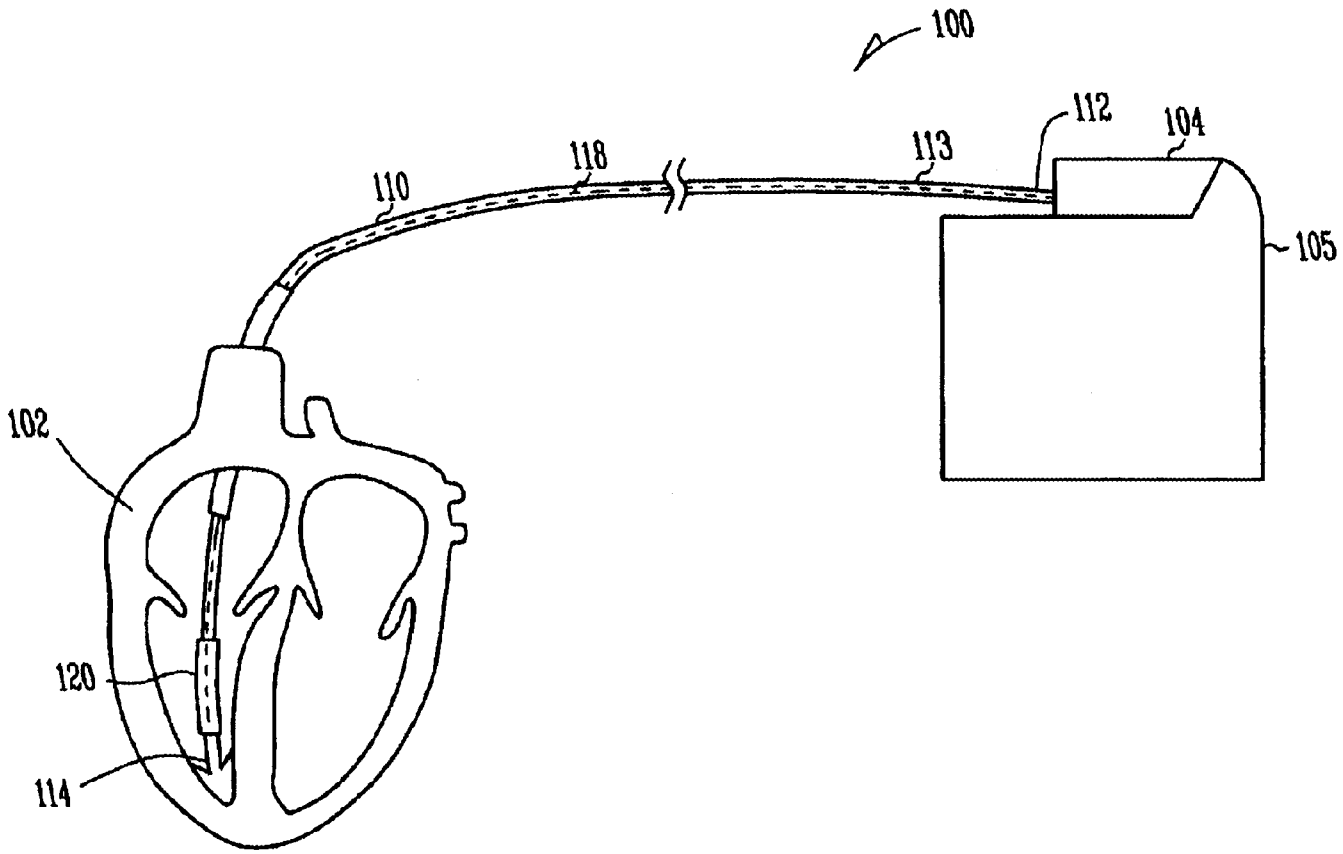
FIG. 1 illustrates a marking system constructed in accordance with one embodiment.

A lead 110 and lead marking system 100 are illustrated in FIG. 1, where FIG. 1 illustrates a system 100 for delivering and/or receiving electrical pulses or signals to stimulate and/or sense the heart 102. It should be noted that the system 100 is suitable for use with implantable electrical stimulators, such as, but not limited to, pulse generators, neuro stimulators, skeletal stimulators, central nervous system stimulators, or stimulators for the treatment of pain. The system 100 includes a pulse generator 105, and at least one lead 110. The pulse generator 105 includes a source of power as well as an electronic circuitry portion, and has a header 104. The pulse generator 105 is a battery-powered device which generates a series of timed electrical discharges or pulses. The pulse generator 105 is generally implanted into a subcutaneous pocket made in the wall of the chest. Alternatively, the pulse generator 105 is placed in a subcutaneous pocket made in the abdomen, or in other locations.

The lead 110 includes a lead body 113 which extends from a proximal end 112, where it is coupled with the pulse generator 105, as further discussed below. The lead 110 extends to a distal end 114, which is coupled with a portion of a heart 102, when implanted. The distal end 114 of the lead 110 includes at least one electrode 120 which electrically couples the lead 110 with the heart 102. It should be noted that instead of, or in addition to the at least one electrode 120, the lead 110 includes a sensor, such as, but not limited to, an accelerometer, a pressure sensor, an oxygen sensor, an impedance sensor, or a hemodynamic sensor. At least one electrical conductor 118 is disposed within the lead 110 and extends from the proximal end 112 to the electrode 120. The at least one electrical conductor 118 electrically couples the electrode 120 with the proximal end 112 of the lead 110. The electrical conductors carry electrical current and pulses between the pulse generator 105 and the electrode 120.

Figure 2:
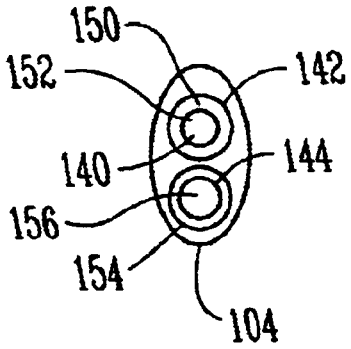
FIG. 2 is a side elevational view illustrating a portion of a header constructed in accordance with one embodiment.

FIG. 2 illustrates a header 104 in greater detail. The header 104 includes one or more openings 140 which are configured to receive therein a lead. The openings 140 further include a header marker 142, which allows for proper identification of a particular lead with respect to a particular opening of a header 104. In addition, as further discussed below, the marker 142 allows for a physician to determine whether a lead has been sufficiently inserted into the header 104. The header marker 142 has a number of different configurations. For instance, in one option, the header marker 142 is disposed directly adjacent to one or more of the openings 140. In another option, the header marker 142 is disposed on an external surface of the header. Still further, in another option, the header marker 142 is disposed around a perimeter 144 of the openings 140, and optionally directly adjacent to the openings 140. In yet another option, the header marker 142 is disposed on an internal surface of the header, as further discussed below. It should be noted that one or more of these options can be combined to achieve variations within the scope of the application.

The header marker 142, in one option, includes one or more colors. For instance, a first opening 150 has a header marker 142 of a first color 152, such as, but not limited to blue, orange, red, yellow, green, purple, or brown. The first color 152 can be distributed around and about the first opening 150 in the variety of manners discussed above, for example completely or partially around the perimeter of the first opening 150. The header 104 further includes a second opening 156 which has associated therewith a second color 154. The second color 154 can be distributed around and about the second opening 156 in the variety of manners discussed above. In another option, the first color 152 and/or the second color 154 include, or alternatively have, a pattern to distinguish the leads therefrom. Having a pattern, as opposed to or in addition to color, would assist individuals who are color blind. Each of the colors and patterns provide a visual indicator to the physician and allow the physician to determine whether or not the lead has been properly associated with a proper opening of the header 104. In addition, it allows the physician to determine whether or not a lead has been properly seated within a header 104, as further discussed below.

Figure 3A:
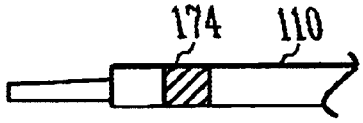
FIG. 3A is a side elevational view illustrating a portion of a lead constructed in accordance with one embodiment.
Figure 3B:
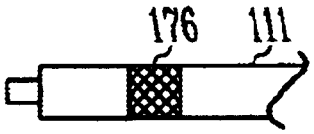
FIG. 3B is a side elevational view illustrating a portion of a lead constructed in accordance with one embodiment.

FIGS. 3A and 3B illustrate a first lead 110 and a second lead 111 for use with the header 104 as described above. The leads 110 and 111 further include a connector 160 which extends from a terminal end 162 to a distal end 164. Disposed proximal to the terminal end 162 is a connector marking 170. The connector marking 170 provides a visual indicator which is designed to match appropriate headers 105, and to allow a physician to determine whether a leads 110, 111 have been properly associated with a respective opening 150, 156 of the proper header 104.

In one option, the connector 160 of the first lead 110 includes a first color 174, and the connector 160 of the second lead 111 includes a second color 176. The first color 174 is designed to match the first color 152 (FIG. 2) and the second color 176 is designed to match the second color 154 (FIG. 2). Similar to what was indicated above, the colors of the connector markings 170 can include, or be used in alternative to, patterns. Each of the connector markings 170 are placed along the connector 160 such that when lead 110 or lead 111 is fully and properly inserted into a proper header 104, the connector marking 170 is fully disposed within the opening 140 (FIG. 2) of the header 104, as shown in FIGS. 4B and 5B. Stated in another way, the connector markings 170 are spaced along the lead such that when the lead is connected to a header with a matching pattern or color, the connector marking 170 having substantially the same color or marking will become hidden within the header. The physician will know that when the connector marking 170 can no longer be seen, the connector 160 is properly placed within the header 104. If the connector marking 170 is still partially outside of the header 104, as shown in FIGS. 4A and 5A, the lead connector 160 must be advanced further into the header 104.

Figure 4A:
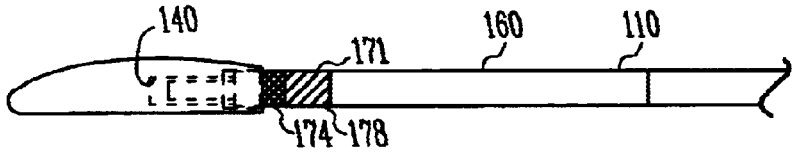
FIG. 4A is a side view illustrating a portion of a lead inserted into a header constructed in accordance with one embodiment.
Figure 4B:
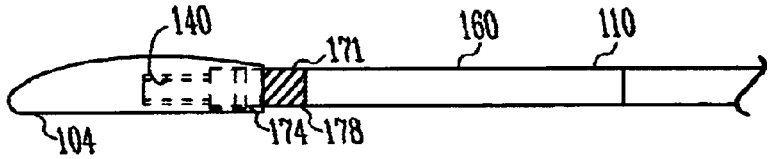
FIG. 4B is a side view illustrating a portion of a lead inserted into a header constructed in accordance with one embodiment.
Figure 5A:
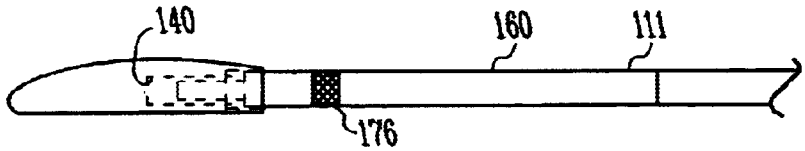
FIG. 5A is a side view illustrating a portion of a lead inserted into a header constructed in accordance with one embodiment.
Figure 5B:
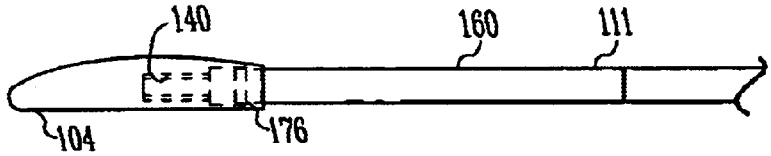
FIG. 5B is a side view illustrating a portion of a lead inserted into a header constructed in accordance with one embodiment.
Figure 6:
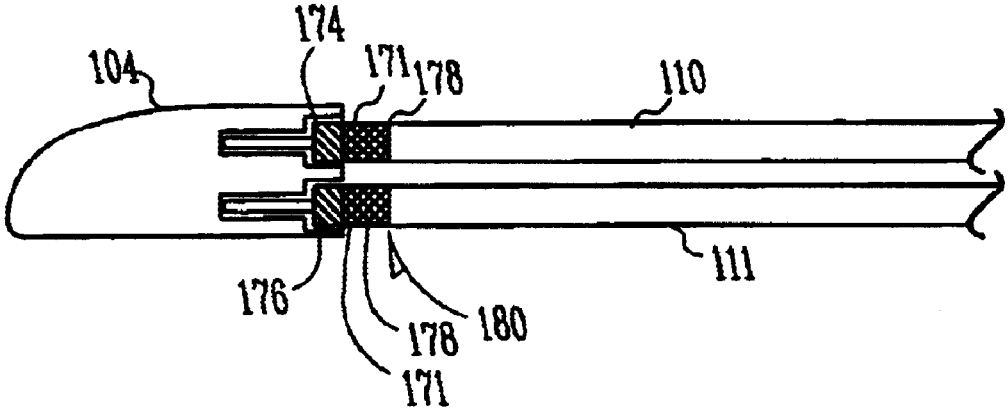
FIG. 6 is a side view illustrating a portion of multiple leads inserted into a header constructed in accordance with one embodiment.

FIGS. 4A and 4B illustrate another embodiment of the system 100. The lead 110 includes a connector marking 170, as discussed above. The lead 110 further includes a second connector marking 171, of a third color or pattern 178. The second connector marking 171 is disposed adjacent to the connector marking 170, such that when the connector marking 170 is properly seated within the header 104, the second connector marking 171 extends outside of the header 104 a predetermined amount. The second connector marking 171 is applied to a plurality of leads in the same respective location on the connector, as shown in FIG. 6. Once the leads 110, 111 have been properly placed within the header 104, an edge surface 180 of the second connector marking 171 is aligned for each lead. This allows for a physician to further verify the proper alignment of all of the leads 110, 111. When held from afar, it is relatively easily determined when the edge surfaces 180 are aligned, as shown in FIG. 6, and provides additional confirmation to the physician that the leads 110, 111 have been properly seated within the header 104.

Figure 7:
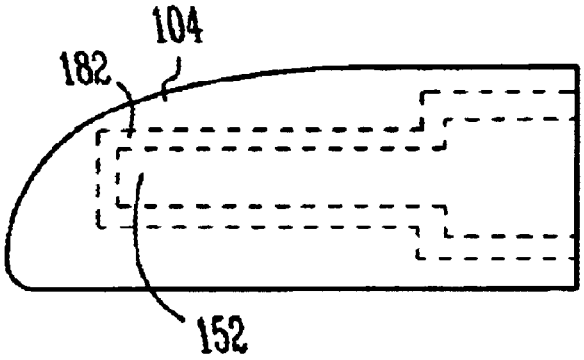
FIG. 7 is a side view illustrating a header constructed in accordance with one embodiment.

FIG. 7 illustrates another option for the header 104. The header 104 is, in one option, translucent. It should be noted that the above-discussed embodiments are optionally translucent, and include the features of this embodiment as well. The header 104 includes a first opening 152 having a header marking 182, that is optionally translucent. The header marking 182 includes a color that substantially matches a color of the lead 110 (FIG. 3A). When lead 110 (FIG. 3A) is the appropriate lead for the first opening 152, the connector marking 170 (FIG. 3A) substantially matches the color of the header marking 182. If the lead is not the appropriate lead for the first opening 152, it will have a different color than the color of the header marking 182, and insertion of the lead therein will change the color of the header marking 182. When the color changes, the physician will know that the wrong lead has been inserted into the first opening 152. This feature can be combined with the embodiments listed above and below. For instance, it can be combined with a header marking on the external surface of the header 104, as discussed above.

The colors or patterns are applied to the leads/headers in various manners. For instance, in one option, a band of material having color is heat shrunk over a portion of the connector. In another option, the band of material is expanded using heptane, placed over the connector, and then allowed to return to its original size. In another option, biocompatible paint, dye, or marking is applied to the connector and/or the header. In yet another option, the connector is laser etched with a pattern, or the marking is printing on to the connector or within the header. In yet another option, the color is molded into the header. Alternatively, a color band is disposed under tubing of the lead. In yet another option, a color swatch is embedded within the header.

Figure 8:
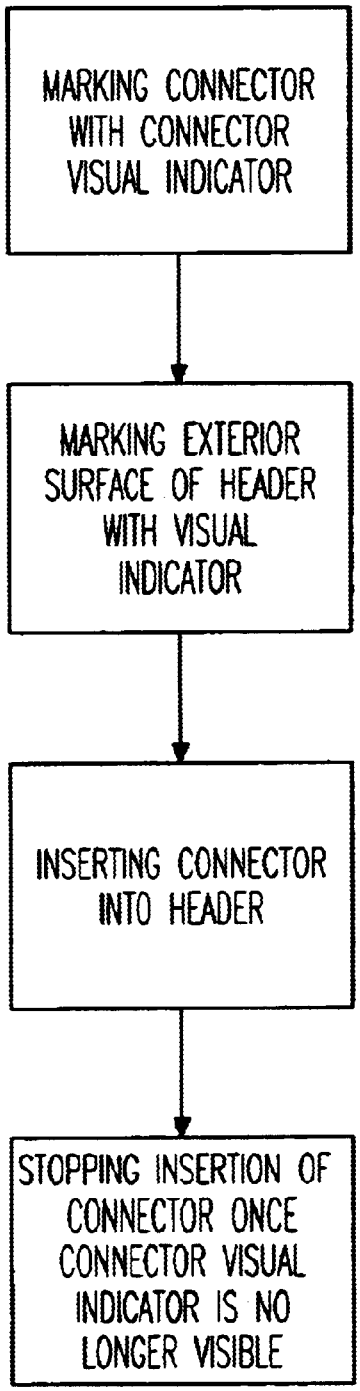
FIG. 8 is a block diagram illustrating a method in accordance with one embodiment.

In another embodiment, as shown in FIG. 8, a method includes marking a connector with at least a first connector visual indicator, marking an external surface of a header with a first header visual indicator, where the first header visual indicator matches the first connector visual indicator. The method further includes inserting the connector into the header, and stopping insertion of the connector into the header once the first connector visual indicator is no longer visible. It should be noted that the method includes incorporation of any of the above discussed embodiments.

Several options for the method are as follows. For instance, in one option, marking the connector comprises marking the connector with a color marking, and marking the header comprises marking the header with a color marking. In yet another option, marking the header comprises marking around an opening of the header, and inserting the connector includes inserting the connector into the opening. The method, in another option, further includes marking a second lead with a second connector visual indicator, disposing the second lead into the second opening, and stopping insertion of the second lead into the second opening when the second connector visual indicator is no longer visible. In another option, marking the header comprises marking around a first opening with the first header visual indicator, and marking around a second opening with a second header visual indicator.

In yet another embodiment, the header is translucent as discussed above. As the connector is inserted into the header, the marker on the connector would match the color marking of the header for the appropriate opening. If the opening is not the correct opening for the connector and lead, the colors would be different, and the color of the header would change as the lead is inserted into the header, signifying to the physician that the lead is improperly seated. In another option, a third color marker is placed on each of the connectors for multiple leads. After the physician has inserted multiple leads into the header, the physician can recheck for proper advancement of the leads by verifying alignment of all of the third color markers.

Advantageously, the above-described system allows for a physician to easily identify whether or when a lead has been properly seated within a header. Furthermore, the system provides for an effective and inexpensive marking system. The system further assists in preventing unnecessary stress exerted on the lead, for example, by a physician checking whether a lead has been properly placed within the header. Still further, the system allows proper identification of leads relative to their appropriate openings within the header. This is particularly important when high voltage and low voltage leads are used in the same header.

It is to be understood that the above description is intended to be illustrative, and not restrictive. Many other embodiments will be apparent to those of skill in the art upon reading and understanding the above description. It should be noted that embodiments discussed in different portions of the description or referred to in different drawings can be combined to form additional embodiments of the present invention. The scope of the invention should, therefore, be determined with reference to the appended claims, along with the full scope of equivalents to which such claims are entitled.

What is claimed is:

1. An assembly comprising:

a translucent header coupled with an energy source, the translucent header embedded with at least a first color;

at least one first connector extending from a terminal end to a distal end, the terminal end disposed within a first opening of the header; and the terminal end having at least one color connector marking thereon, the at least one connector marking providing a visual indication proper placement of the connector within the header, the at least one connector marking substantially similar to the at least first color, wherein the at least one connector marking is disposed completely within the first opening of the header indicating when the connector is seated therein.

2. The assembly as recited in claim 1, further comprising a second connector having a second connector marking of a second color, and the at least one first connector marking includes a first connector marking of a first color, and the first color is different than the second color.

3. The assembly as recited in claim 2, wherein the second connector includes a third connector marking of a third color, and the first connector includes a fourth connector marking of the third color, and the third connector marking and the fourth connector marking are substantially aligned when the first connector and the second connector are properly seated within the header.

4. The assembly as recited in claim 1, further comprising at least one header marking on the header, wherein at least one header marking is disposed around the first opening of the header, the at least one header marking disposed on an external surface of the header.

5. The assembly as recited in claim 1, wherein the header includes a second color, and the first color is different than the second color.

6. The assembly as recited in claim 1, wherein the first color is embedded adjacent to the at least one opening.

7. A system comprising:

an implantable electrical stimulator;

a connector coupled with a lead having a lead body and at least one electrical component, the connector coupled with the implantable electrical stimulator; and a means for visually indicating when the connector is properly seated within the implantable electrical stimulator, where the means for visually indicating is applied to the connector and an external surface of the implantable electrical stimulator; and a means for visually indicating whether a proper connector is coupled with the implantable electrical stimulator, including a first visual indicator on the connector and a second visual indicator on the electrical stimulator, wherein the first visual indicator has a color or pattern marking, the means for visually indicating when the connector is properly seated is coupled with the electrical stimulator, and the first visual indicator is completely disposed internally to the implantable electrical stimulator when the connector is properly seated within the implantable electrical stimulator; and the first visual indicator is substantially similar to the second visual indicator.

8. The system as recited in claim 7, wherein the second visual indicator is disposed directly adjacent to an opening of the implantable electrical stimulator.

9. The system as recited in claim 8, wherein the second visual indicator is disposed around a perimeter of the opening of the implantable electrical stimulator, and the opening receives the connector therein.

10. The assembly as recited in claim 7, wherein a part of the implantable electrical stimulator is translucent.

11. A system comprising:

a lead extending from a proximal end to a distal end, the lead including a lead body;

a connector coupled with the proximal end of the lead, the connector including a terminal end;

an implantable electrical stimulator having an opening therein, the opening configured to receive the connector therein;

at least one first visual indicator marked around the opening of the implantable electrical stimulator; and at least one color or pattern connector marking disposed on the terminal end, the connector marking is substantially similar as the first visual indicator, the color or pattern connector marking disposed fully within the opening when the connector is properly seated within the opening.

12. The system as recited in claim 11, wherein the implantable electrical stimulator includes a second opening therein, the second opening having a second visual indicator marked around the second opening, where the second visual indicator is different than the first visual indicator.

13. The system as recited in claim 11, further comprising a second lead having a second connector, the second connector including a second connector marking thereon, the second connector marking is substantially similar to the second visual indicator.

14. The system as recited in claim 11, wherein the implantable electrical stimulator includes a header, and the header is translucent and includes a color embedded therein.

15. A method comprising:

marking a connector with at least a first connector visual indicator having a color pattern marking;

marking an external surface of a header with a first header visual indicator;

inserting the connector into the header; and stopping insertion of the connector into the header once the first connector visual indicator is no longer visible, wherein the first header visual indicator is substantially similar to the first connector visual indicator prior to insertion.

16. The method as recited in claim 15, wherein marking the connector comprises marking the connector with a color marking, and marking the header comprises marking the header with a color marking.

17. The method as recited in claim 15, wherein marking the header comprises marking around an opening of the header, and inserting the connector includes inserting the connector into the opening.

18. The method as recited in claim 15, wherein marking the header comprises marking around a first opening with the first header visual indicator, and marking around a second opening with a second header visual indicator.

19. The method as recited in claim 15, further comprising marking a second lead with a second connector visual indicator, disposing the second lead into the second opening, and stopping insertion of the second lead into the second opening when the second connector visual indicator is no longer visible.

* * * * *